US006213453B1

(12) United States Patent
Ou

(10) Patent No.: US 6,213,453 B1
(45) Date of Patent: Apr. 10, 2001

(54) GASIFICATION AUXILIARY DEVICE FOR HIGH PRESSURE OIL EJECTION

(76) Inventor: Ren-Sheng Ou, 4F, No. 62, Sec. 2, Hsing Lung Rd., Taipei (TW)

( * ) Notice: Subject to any disclaimer, the term of this patent is extended or adjusted under 35 U.S.C. 154(b) by 0 days.

(21) Appl. No.: 09/363,223

(22) Filed: Jul. 30, 1999

(51) Int. Cl.[7] ..... F02M 37/14

(52) U.S. Cl. ..... 261/78.1; 48/189.4; 366/340

(58) Field of Search ..... 261/78.1, 78.2, 261/108, 123, DIG. 55; 366/336, 340; 48/102 R, 189.4, 116, 117

(56) References Cited

U.S. PATENT DOCUMENTS

| | | | | |
|---|---|---|---|---|
| 454,925 | * | 6/1891 | Wood | 48/117 X |
| 819,211 | * | 5/1906 | Driscoll | 48/102 R |
| 1,218,545 | * | 3/1917 | Giddens | 48/189.4 |
| 1,730,453 | * | 10/1929 | Devon | 48/189.4 |
| 2,293,421 | * | 8/1942 | Baetz | 48/102 R |
| 2,496,557 | * | 2/1950 | Nordenskjold et al. | 366/336 |
| 2,965,695 | * | 12/1960 | Sleicher, Jr. | 366/336 |
| 3,045,984 | * | 7/1962 | Cochran | 366/340 |
| 3,361,412 | * | 1/1968 | Cole, III | 261/78.2 |
| 3,761,066 | * | 9/1973 | Wheeler | 261/78.2 |
| 4,798,475 | * | 1/1989 | Strandberg | 366/336 X |
| 4,869,849 | * | 9/1989 | Hirose et al. | 261/78.2 |

* cited by examiner

*Primary Examiner*—Richard L. Chiesa
(74) *Attorney, Agent, or Firm*—Varndell & Varndell, PLLC

(57) ABSTRACT

A gasification auxiliary device for high pressure oil ejection is disclosed, especially, a multiple penetrating gasification auxiliary device. The device can be used to atomize oil molecules. The gasification auxiliary device includes an upper case, a lower case, and two banks of gasification blades. The two banks of gasification blades are alternatively arranged with one another. The gasification blades can be provided within the device, so that the lower half edges and upper half edges of alternative gasification blades do not have gasification holes and are tightly connected to the case. Alternatively, the gasification blades can be arranged within the device, so that a gap exists alternatively between the upper and lower edge of the gasification blades and the wall of the case. When oil under high pressure is ejected into the device, the oil molecules will pass through the holes or gaps and gasify.

8 Claims, 6 Drawing Sheets

GASIFICATION AUXILIARY DEVICE FOR HIGH PRESSURE OIL EJECTION

FIELD OF THE INVENTION

The present invention relates to a gasification auxiliary device for high pressure oil ejection, and especially to a gasification auxiliary device with multiple penetrating layers by which oil molecules may atomize completely.

BACKGROUND OF THE INVENTION

In a prior art oil ejecting system, the oil from an oil tank passes through an oil filter for filtering, and a high pressure pump serves to atomize the oil so that the oil molecules will pass through a carburetor to mix with air for ignition. However, since in the prior art oil ejecting system, only a high pressure pump serves to atomize the oil, the oil molecules are not gasified completely and do not completely mix with air.

SUMMARY OF THE INVENTION

Accordingly, the primary object of the present invention is to provide a gasification auxiliary device for high pressure oil ejection which can be installed between a high pressure pump and a carburetor. By use of banks of gasification blades alternatively arranged with one another, as high pressure ejecting oil is ejected, then the oil molecules will pass through the gasification blades and gasify completely.

Another object of the present invention is to provide a gasification auxiliary device for high pressure oil ejection, gasification holes are formed on the gasification blades; or gaps are formed between the upper edge of the gasification blade and the wall of the case in other side. Accordingly, as high pressure ejecting oil is ejected, then the oil molecules will pass through the holes or gaps and completely contact with air so to gasify completely.

The various objects and advantages of the present invention will be more readily understood from the following detailed description when read in conjunction with the appended drawing.

DETAILED DESCRIPTION OF THE PREFERRED EMBODIMENTS

Figure 1:
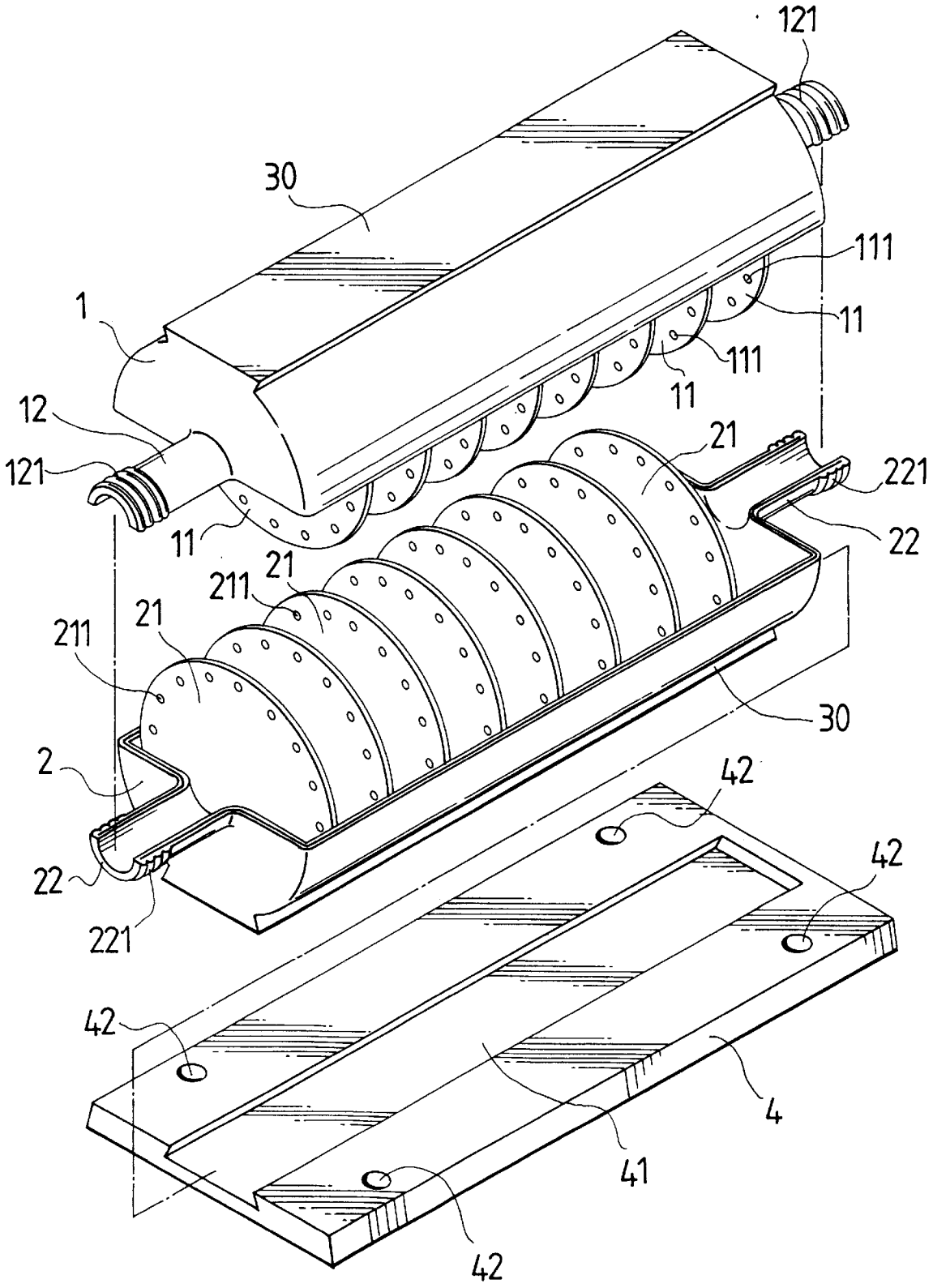
FIG. 1 is an exploded perspective view of the present invention.
Figure 2:
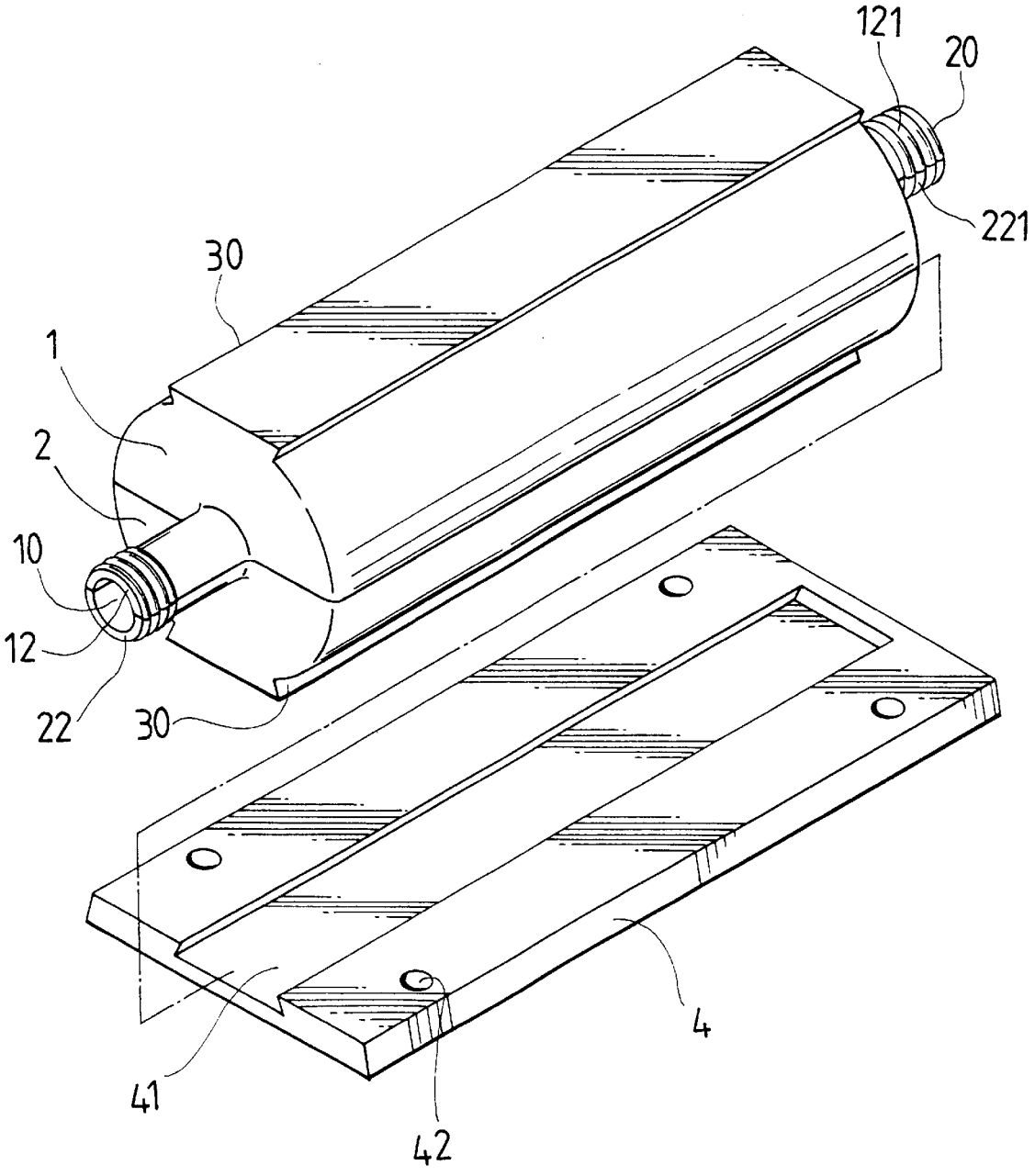
FIG. 2 is an exploded perspective view showing the present invention being assembled to a bearing plate.
Figure 4:
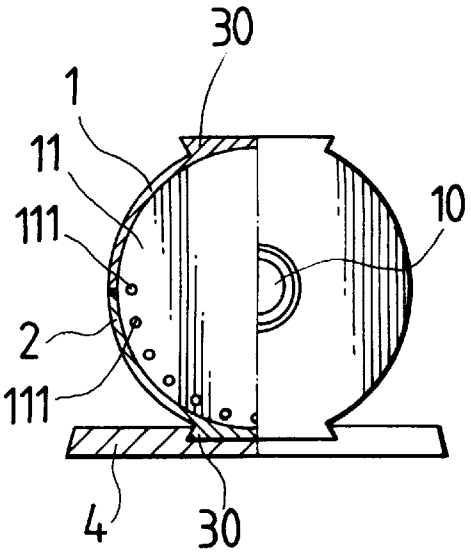
FIG. 4 is a lateral partial cross sectional view of the present invention.
Figure 3:
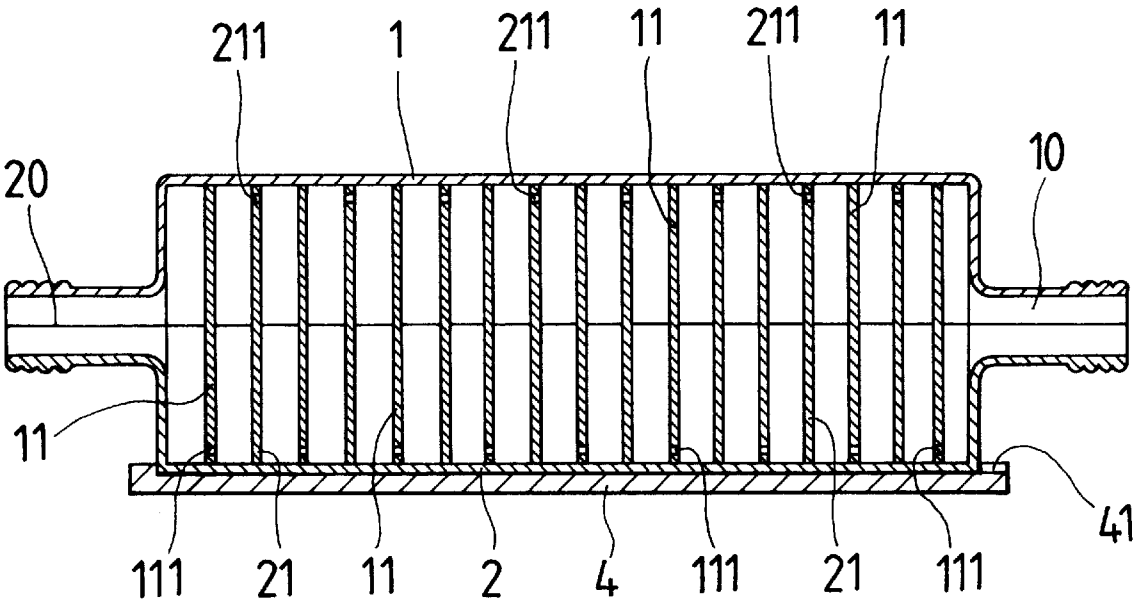
FIG. 3 is a cross sectional view showing the present invention being assembled.

With reference to FIGS. 1 to 4, the gasification auxiliary device for high pressure oil ejection of the present invention is illustrated. The gasification auxiliary device includes at least an upper case 1 and a lower case 2, and two banks of gasification blades 11, 22. The openings of the upper case 1 and lower case 2 are matched with one another. The two banks of gasification blades 11 and 21 are alternatively arranged with one another. Two ends of each case 1 and 2 have respective half joints 12 and 22 so that as the two cases 1 and 2 are combined, two joints are formed, one is an oil inlet joint 10, the other is an oil outlet joint 20. A plurality of circular ribs 121 and 221 are located around the outer walls of the joints in order to prevent the joints from releasing when they are connected with oil tubes.

The gasification blades 11 and 21 are formed at inner walls of the upper case 1 and the lower case 2 and are alternatively arranged. A plurality of gasification holes 111 and 211 are respectively formed on the upper half edges and the lower half edges of the gasification blades 11 and 21. Lower half edges of the gasification blades 21 without gasification holes are tightly connected to the case 2, and upper half edges of the gasification blades 11 without holes are tightly connected to the case 1.

Figure 5:
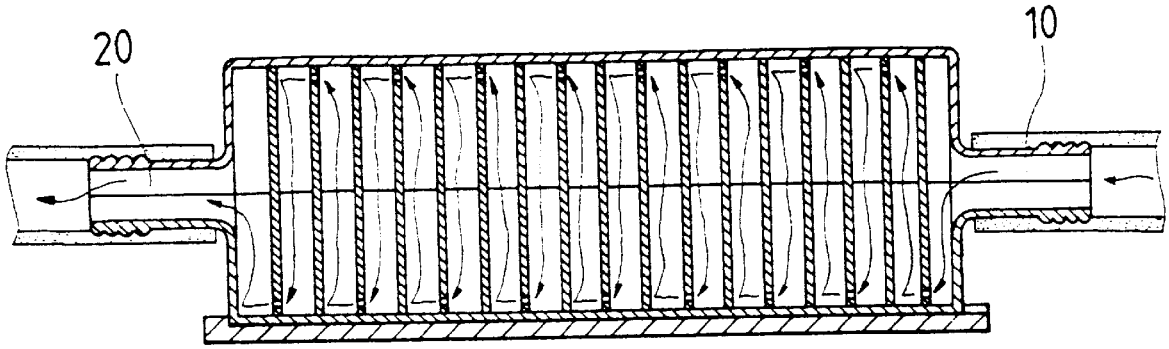
FIG. 5 is a schematic view showing that the oil molecules pass through the gasification holes of the present invention.
Figure 6:
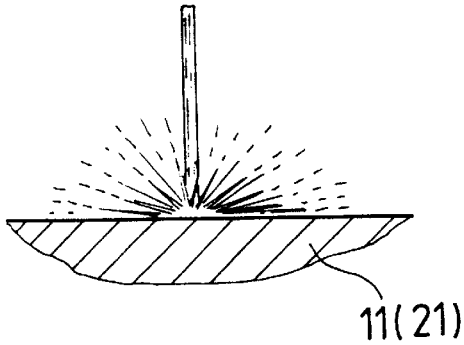
FIG. 6 is a schematic view showing that the oil molecules impact the wall in a high pressure.
Figure 7:
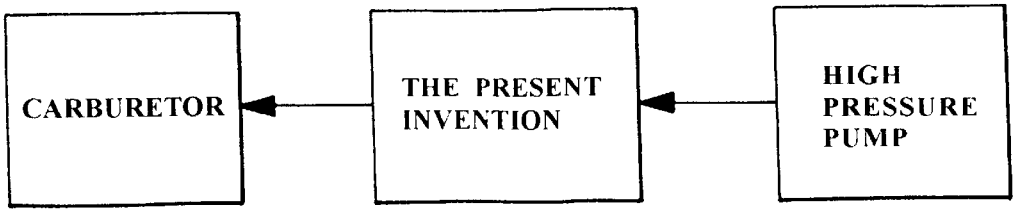
FIG. 7 is a block diagram showing that the present invention is installed in the oil ejecting system.

By the aforementioned components, a gasification auxiliary device can be formed. When a high pressure ejecting oil enters into the device from the oil inlet joint 10, the oil molecules will flow through the gasification holes 111 and 211. Therefore, a multiple gasification effect is achieved (as shown in FIG. 5). Oil molecules will impact the gasification blades repeatedly in high pressure (as shown in FIG. 6). Eventually, almost all the oil will be gasified. Thus, the oil completely contacts with air and a uniform mixing ratio is attained. The gas ejecting system of the present invention can be installed between a high pressure pump and a carburetor (as shown in FIG. 7). As a result, a gasification auxiliary device for high pressure oil ejection is formed.

Figure 8:
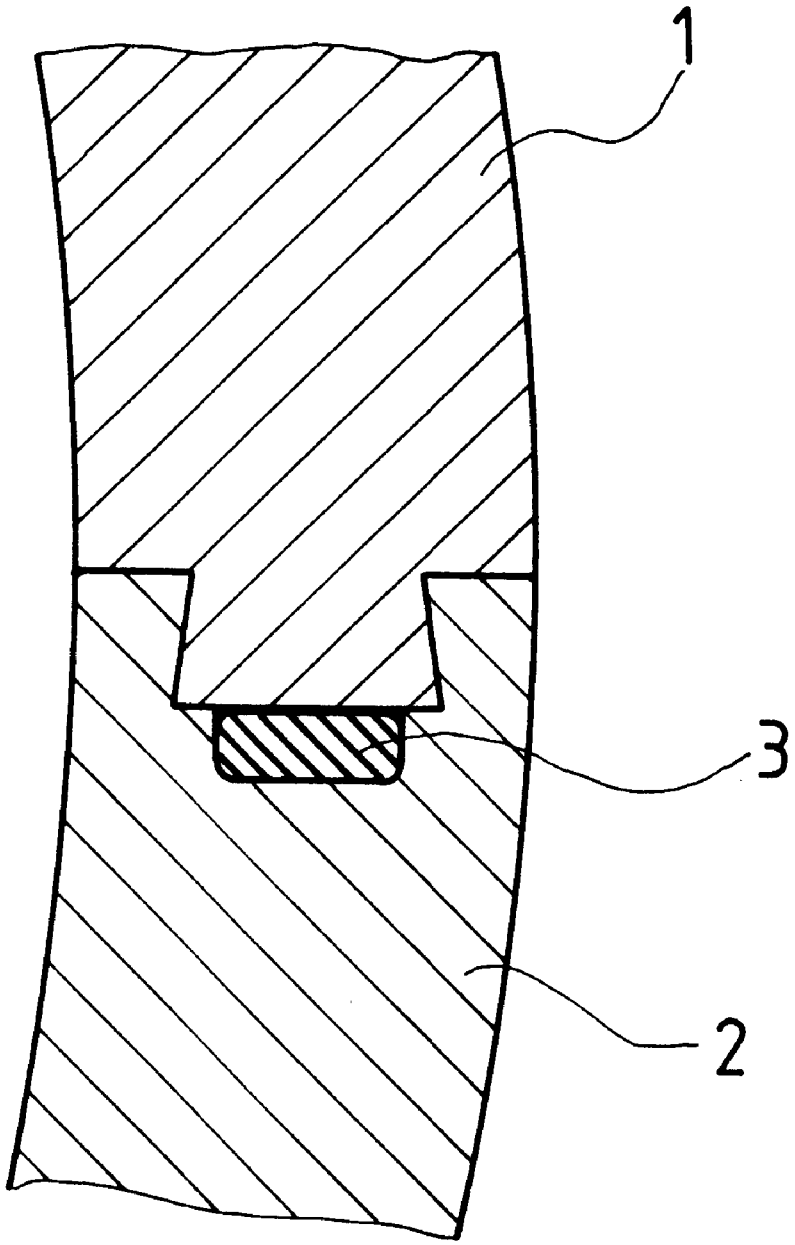
FIG. 8 shows that the upper case and lower case of the present invention are sealed by an oil seal.

When the aforementioned upper case 1 and lower case 2 are combined, an oil sealing (as shown in FIG. 8) is covered in the combined portion so that a good sealing is formed after combination and the gas will not vent out.

Figure 10:
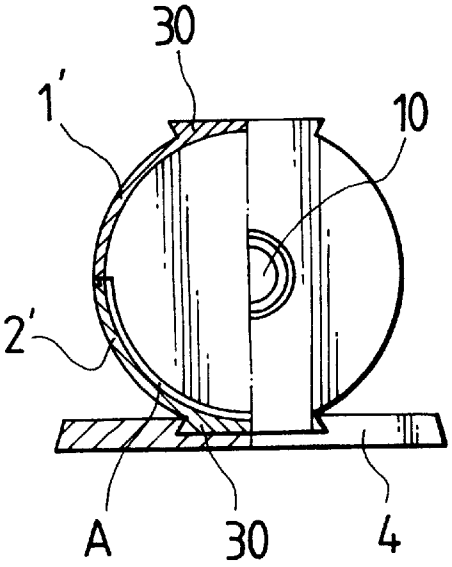
FIGS. 9 and 10 are lateral and end partially illustrating another embodiment of the present invention.
Figure 9:
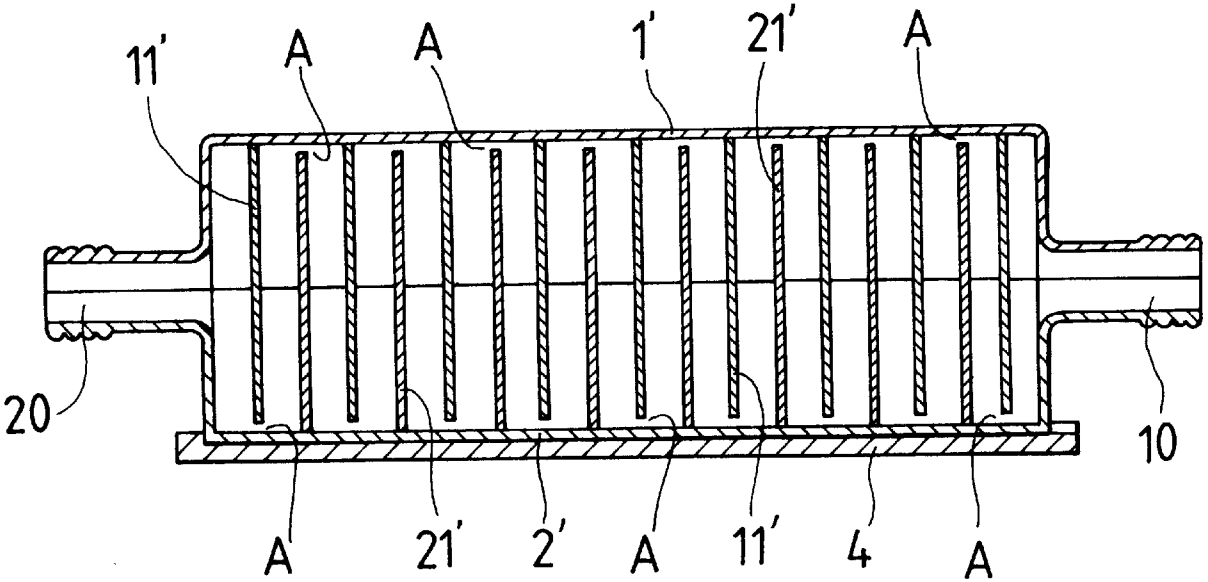

Referring to FIGS. 9 and 10, the upper case 1', lower case 2' and gasification blades 11' and 12' can be modified so that the a gap A is exists between the upper or lower edge of the gasification blade and the wall of the case. Accordingly, the aforementioned air holes can be replaced with openings. As high pressure ejecting oil is ejected, then the oil molecules will pass through the gaps so to gasify completely.

A dovetail block 30 can be installed at the outer wall of the upper case 1 or 1' and the lower case 2 or 2' and a bearing plate 4 with respect to the dovetail block 30 is also installed so that a steady combination is formed. The bearing plate 4 may be installed with a lock hole 42 for being assembled by the oil ejecting system.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A gasification auxiliary device for high pressure oil ejection comprising an upper case, a lower case, and first and second banks of gasification blades installed between in the upper and lower cases; the upper and lower cases having matching shapes and first and second ends, the upper and lower cases are jointed together to form a cylindrical container having an oil inlet at their first ends and an oil outlet at their second ends; and individual members of the first and second banks of the gasification blades are alternatively arranged between the upper and lower cases along an axis of the cylindrical container, the first and second banks of gasification blades respectively having a top and a bottom, the top and bottom of the gasification blades are respectively arranged at inner walls of the upper case and the lower case, one of the first and second banks of gasification blades having openings arranged at the top thereof, and the other of the first and second banks of gasification blades having openings arranged at the bottom thereof, and the first and second banks of gasification blades are arranged so that when oil under high pressure is received in the oil inlet, oil molecules flow through the openings of the first and second banks of gasification blades alternatively arranged at the top and bottom of the first and second banks of gasification blades, thereby gasifying the oil.

2. The gasification auxiliary device for high pressure oil ejection as claimed in claim 1, wherein the first and second ends of the upper and lower cases respectively have half joints; so that when the upper and lower cases are combined, two joints are formed, one is an oil inlet joint, and the other is an oil outlet joint.

3. The gasification auxiliary device for high pressure oil ejection as claimed in claim 1, wherein circular ribs are installed around the outer walls of the oil inlet and the oil outlet.

4. The gasification auxiliary device for high pressure oil ejection as claimed in claim 1, wherein an oil sealing is preinstalled in an interface between the upper case and the lower case for enhancing the sealing therebetween.

5. The gasification auxiliary device for high pressure oil ejection as claimed in claim 1, wherein the openings of the first and second banks of gasification blades are gaps arranged between respective gasification blades and the inner wall of the upper and lower cases.

6. The gasification auxiliary device for high pressure oil ejection as claimed in claim 5, wherein a dovetail block is installed at an outer wall of the upper case and the lower case, and a bearing plate with respect to the dovetail block is also installed so that a secure combination is formed.

7. The gasification auxiliary device for high pressure oil ejection as claimed in claim 1, wherein a dovetail block is installed at an outer wall of the upper case and the lower case, and a bearing plate with respect to the dovetail block is also installed so that a secure combination is formed.

8. The gasification auxiliary device for high pressure oil ejection as claimed in Claim 1, wherein the openings of the first and second banks of gasification blades are gasification holes.

* * * * *